US007866384B2

(12) United States Patent
Hall

(10) Patent No.: US 7,866,384 B2
(45) Date of Patent: Jan. 11, 2011

(54) DOWNHOLE DEVICE

(75) Inventor: Robert Neil Hall, Balmedie (GB)

(73) Assignee: Wireline Engineering Limited, Aberdeen (GB)

( * ) Notice: Subject to any disclaimer, the term of this patent is extended or adjusted under 35 U.S.C. 154(b) by 74 days.

(21) Appl. No.: 11/658,166

(22) PCT Filed: Aug. 11, 2005

(86) PCT No.: PCT/GB2005/003137

§ 371 (c)(1),
(2), (4) Date: Jan. 22, 2007

(87) PCT Pub. No.: WO2006/016155

PCT Pub. Date: Feb. 16, 2006

(65) Prior Publication Data

US 2008/0164018 A1 Jul. 10, 2008

(30) Foreign Application Priority Data

Aug. 12, 2004 (GB) ..... 0417937.0

(51) Int. Cl.
*E21B 17/10* (2006.01)

(52) U.S. Cl. ..... 166/241.3; 166/241.1; 166/241.5; 175/76; 175/325.3

(58) Field of Classification Search ..... 166/241.1, 166/241.3, 241.5; 175/76, 325.3
See application file for complete search history.

(56) References Cited

U.S. PATENT DOCUMENTS

| | | | | |
|---|---|---|---|---|
| 4,620,802 | A | 11/1986 | Harrel et al. | |
| 4,793,412 | A * | 12/1988 | Rivas et al. | 166/241.3 |
| 6,684,965 | B1 * | 2/2004 | Bakke | 175/99 |
| 7,395,881 | B2 * | 7/2008 | McKay et al. | 175/325.3 |
| 2002/0139538 | A1 * | 10/2002 | Young et al. | 166/380 |
| 2003/0075321 | A1 | 4/2003 | Hall | |
| 2004/0055786 | A1 * | 3/2004 | Maguire et al. | 175/50 |

FOREIGN PATENT DOCUMENTS

| | | | |
|---|---|---|---|
| CA | 1 231 866 | | 1/1988 |
| GB | 2275284 | * | 8/1994 |
| WO | WO 01/40615 | * | 6/2001 |
| WO | WO 2005/111368 A1 | | 11/2005 |

* cited by examiner

*Primary Examiner*—Jennifer H Gay
*Assistant Examiner*—Sean D Andrish
(74) *Attorney, Agent, or Firm*—Drinker Biddle & Reath LLP

(57) ABSTRACT

The invention relates to a downhole device for incorporation into a downhole string and movement in a wellbore. The device comprises a body member, at least one roller arranged on the device to engage the inner surface of the wellbore and means to orient the device in the wellbore. The means to orient the device are provided on the or each roller. Preferably the means to orient the device comprise a projecting portion provided on the or each roller which projects radially outwardly from the body member. The projecting portion can be an eccentrically-shaped portion of the or each roller.

18 Claims, 6 Drawing Sheets

DOWNHOLE DEVICE

This Application is the U.S. National Phase Application of PCT International Application No PCT/GB2005/003137 filed Aug. 11, 2005. The invention relates to a downhole device, and particularly but not exclusively a downhole device adapted for use in wireline or slickline applications.

DESCRIPTION OF THE RELATED ART

In conventional wireline and slickline operations, a toolstring comprising different tools is lowered into casing, tubing or other tubulars in a borehole from a wire or cable spooled from a drum located at the surface of the wellbore. It is often necessary to perform wireline or slickline operations during for example completion, maintenance and servicing, installation and retrieval of downhole apparatus, intervention and well logging. Toolstrings often comprise one or more devices that collect data from the wellbore such as temperature, salinity etc of recovered fluids. In addition to suspending the string of tools, the wire or cable spooled from a drum may also act as a conduit for power required by the tools to carry out their functions in the wellbore, and may include signal cables for conveying data gathered by downhole sensors back to the surface.

Toolstrings operate satisfactorily in vertical and near vertical wells, but problems arise when they are used in deviated wells since contact between the outer diameter of the toolstring and the inner diameter of the wellbore casing or other tubular creates a frictional force which acts against the gravitational forces urging the toolstring downhole, and these frictional forces increase with the deviation of the well. In addition, as deviation increases, the string is more likely to snag on the casing connections or other raised surfaces on the inner wall of the casing or other tubular.

Roller bogies incorporated into the toolstring to assist the movement of toolstrings within casing or other tubulars in such deviated wells are available; however, contortions throughout the length of the casing or other tubular, and in the toolstring itself, often results in the rollers of such conventional roller bogies failing to make contact with the inner diameter of the casing or tubular. This reduces or removes the effect of the roller bogie and can result in parts of the toolstring contacting the inner diameter of the casing or other tubular regardless of the provision of the roller bogie.

BRIEF SUMMARY OF THE INVENTION

According to the present invention there is provided a downhole device for incorporation into a downhole string and movement in a well-bore, the device comprising:

one body member;

at least one roller arranged on the device to engage the inner surface of the well-bore; and means to orient the device in the well bore, the means to orient the device is provided on the or each roller.

Optionally, the means to orient the device comprises a projecting portion of the or each roller which projects from the body of the device in the direction of the axis of rotation of the or each roller by a distance at least equal to and preferably greater than the diameter of the or each roller.

When the dimension along the axis of rotation of the rollers of the device is larger than the diameter of the roller, a degree of eccentricity is provided on the device, in order to allow the device to assume a desirable orientation e.g. with the rollers in contact with the inner surface of the casing or other tubular in which it is run.

Optionally, the projecting portion of the or each roller is an eccentrically shaped portion of the or each roller. Typically, the eccentrically shaped portion comprises an oval shape which extends from the outer diameter of the roller to the end of the projecting portion.

Alternatively, the means to orient the device is provided by the or each roller being offset from the longitudinal axis of the device such that the or each roller projects from the body of the device in the direction of the axis of rotation of the or each roller by a distance at least equal to and preferably greater than the diameter of the or each roller.

Typically, the or each roller comprises a running edge which extends around the outer circumference of the or each roller. Preferably, the running edge is shaped such that it matches the internal surface of the well bore in which the device is to be run.

Optionally, the or each roller is secured to the device via a pin which typically also provides an axis of rotation about which the or each roller may rotate.

Optionally, the or each roller is provided with rotational friction reducing means adapted to reduce the frictional forces created when the or each roller rotates about the axis of rotation.

Typically, the frictional reducing means comprises a bearing arrangement adapted to act between a portion of the or each roller and a portion of the pin. Alternatively, the frictional reducing means comprises a slip surface provided on a portion of the or each roller in abutment with a slip surface provided on a portion of the body member of the device.

Optionally, the friction reducing means may also provide an axis of rotation about which the or each roller may rotate.

Typically, the slip surfaces comprise a durable low friction material such as ceramic.

Optionally, a plurality of rollers are provided on opposing sides of the device. Alternatively, a plurality of rollers are alternately spaced along the device such that a roller is provided on one side of the device at a first location followed by another roller on the other side of the device at a second location followed by a another roller on the same side as the roller at the first location. Typically, this alternation continues along the length of the device for the plurality of rollers.

Preferably, the or each rollers are provided in a recess provided in the body of the device.

Preferably, the device comprises at least a swivel device.

Optionally, a throughbore capable of housing at least an elongate member such as a cable or wire may be provided along the body of the device, typically along the longitudinal axis of the device.

BRIEF DESCRIPTION OF THE SEVERAL VIEWS OF THE DRAWINGS

Embodiments of the present invention will now be described by way of example only with reference to the accompanying drawings, in which.

DETAILED DESCRIPTION OF THE INVENTION

Figure 1A:
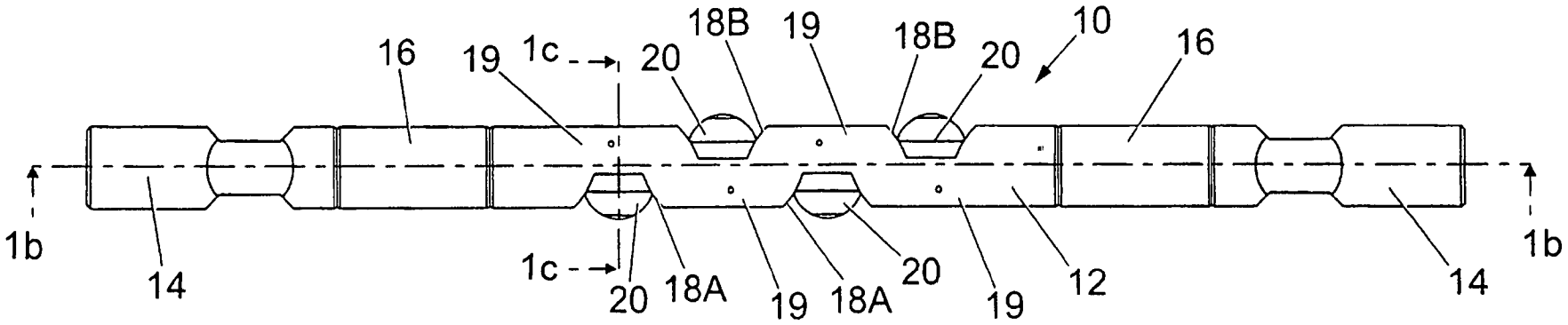
FIG. 1*a* is a planer view of a first embodiment of the device in accordance with the present invention.
Figure 1B:
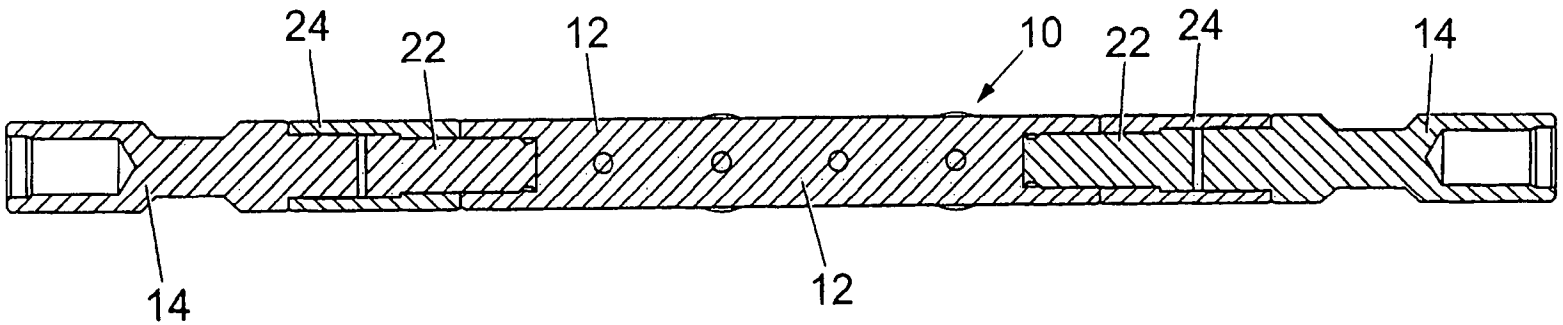
FIG. 1*b* is a transverse cross-sectional view of the device of FIG. 1*a* taken through the view 1*b*-1*b;*
Figure 1C:
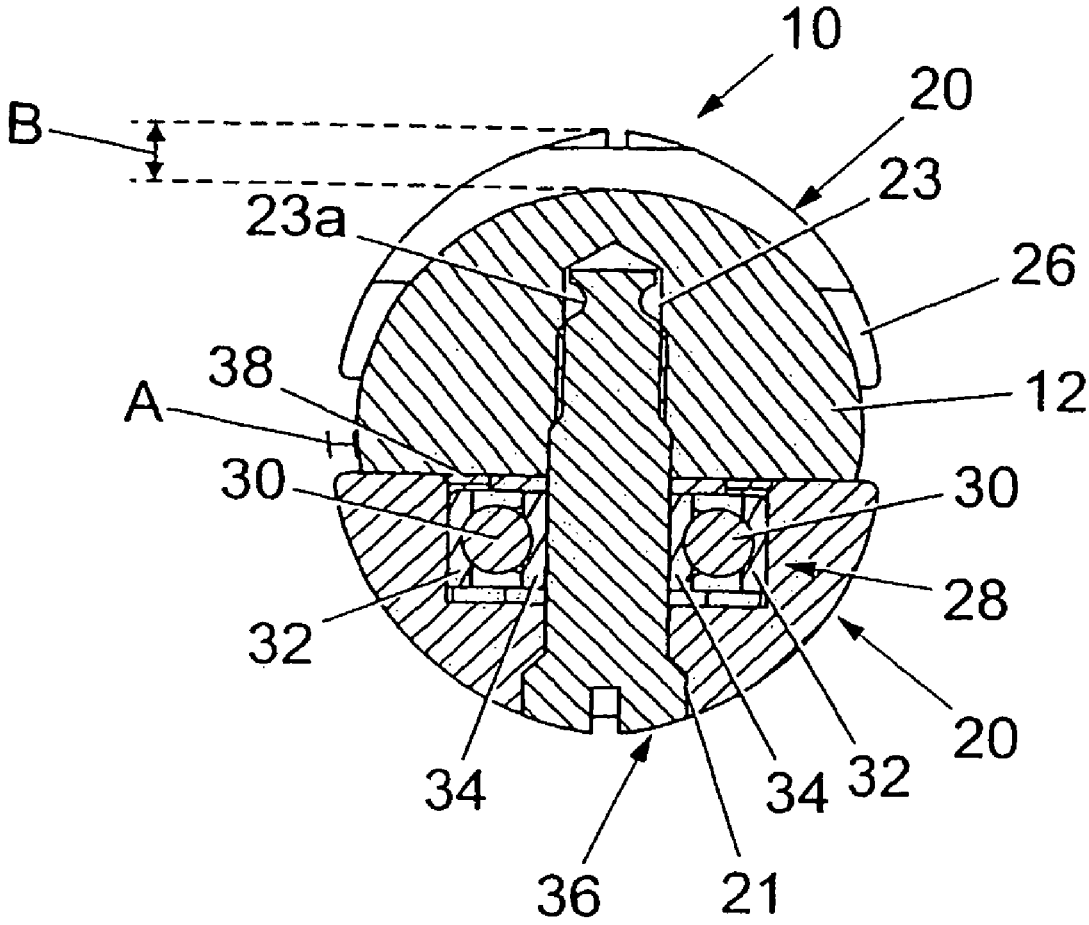
FIG. 1*c* is a cross-sectional view of a roller of the device of FIG. 1*a* taken through the view 1*c*-1*c;*

Referring to FIGS. 1*a*, 1*b* and 1*c* and according to a first embodiment of the present invention, the device comprises a downhole sub 10 having a body 12 provided with suitable connections 14 at either end in order to allow the downhole sub 10 to be attached into a string of wireline tools for e.g. well intervention or MWD operations etc. The connections 14 may be conventional box and pin type connections or any other suitable connections as required to allow connection to rest of the string. Swivels 16 are typically provided at each end of the body 12 in order to allow the downhole sub 10 to rotate independently of the connections 14, and hence the rest of the toolstring (not shown) in the casing or tubular (not shown) as will be described subsequently.

The body 12 of the downhole sub 10 comprises a substantially circular cross-sectioned cylindrical member (best shown in FIG. 1*c*) having a number of recesses 18 provided at intervals along the length of the body 12. Each recess 18 comprises an indent on one side of the body 12 and are staggered along the length of the body 12 such that a recess 18A is positioned on the left hand side of the body 12 and is followed by a recess 18B on the right hand side of the body 12 which in turn is followed by a recess 18A on the left hand side of the body 12 and so on along the length of the body. The body 12 connects at either end to a pin 22 which is surrounded by a rotating collar 24 of the swivel 16. The rotating collar 24 of each swivel 16 is connected to the connections 14 in order to provide a rotational dislocation of the device 10 from the rest of the toolstring (not shown).

The staggered arrangement of recesses 18 provides a degree of flexibility in the sub 10 whilst maintaining sufficient structural integrity of the sub 10. As the sub 10 moves downhole it is able to flex at bridging locations 19 on the body 12 due to the lower bending resistance of the reduced cross-sectional area provided by recessed portions 18. In this regard it should be noted that although four recesses 18 are shown in the embodiment of FIGS. 1*a*, 1*b* and 1*c*, more or fewer recesses 18 may be provided, and the distance between the recesses 18 can be increased or decreased such that the bending resistance of the body 12 may be altered during manufacture of the sub 10 as required for specific downhole situations.

Rollers 20 are housed within each recess 18 and project therefrom. Each roller 20 comprises an oval shaped rotating member having a machined running edge 26 (best shown in FIG. 1*c*) which circumscribes a portion of the circumference of the roller 20 adjacent its equator. The running edge 26 may be machined during manufacture such that its outer circumference matches the inner circumference of the casing or other tubular in which the sub 10 is to operate.

Each roller 20 projects from the body 12 by a small amount, indicated by A in FIG. 1*c*, in the order of 3-25 mm adjacent the machined running edge 26 and by a greater amount, indicated by B in FIG. 1*c*, in the order of 5-30 mm adjacent a securing pin 36. The projection differential between distances A and B may be provided by an asymmetrically shaped roller 20 which has a greater diameter across one axis than an axis perpendicular to that axis i.e. one half of a three dimensional oval roller 20 or a substantially uniformly dimensioned semi-spherical roller which has been offset from the body 12 longitudinal axis by a sufficient amount to provide the required differential, or may simply be provided by a portion of the apparatus (such as the pin 36) extending by the distance B from the body 12. This gives the sub 10 a degree of asymmetry via the rollers 20.

In the embodiment shown in FIGS. 1*a*, 1*b* and 1*c* a ball bearing cage 28 is provided in a cavity on the inside of each roller 20 and encloses a number of ball bearings 30 therein. The ball bearing cage 28 has an outer race 32 in communication with the inside of the roller 20 and an inner race 34 in communication with the outside edge of the securing pin 36. The outer race 32 may be secured to the inside of the roller 20 or may simply form an interference fit therebetween. Likewise the inner race 34 may be secured to the pin 36 or may simply form an interference fit therebetween. The number of ball bearings 30 are housed within the circumference of the ball bearing cage 28.

The securing pin 36 secures each roller 20 to the body 12 by projecting through a throughbore 21 in the roller 20 and into an appropriately dimensioned socket 23 in the body 12 such that the roller 20 is secured to the body 12. The pin 36 may be held in the socket 23 by a latching pin (not shown) which can be inserted into detent 23*a* provided between the pin 36 and the socket 23 bore. In order to ensure that the rollers 20 are not prevented from rotating by the securing action of the securing pin 36, a spacer 38 is provided between the ball bearing cage 28 and the recess 18 on the body 12 such that the roller 20 is secured to the body 12 but does not abut thereagainst.

Operation of the first embodiment of the downhole sub 10 will now be described.

When the toolstring (not shown) is fed downhole from the surface, the sub 10 is incorporated into the toolstring by connecting it thereto at connections 14 such that the downhole sub 10 is integrated into the toolstring. The toolstring including the downhole sub 10 is then progressed into a downhole tubular such as wellbore casing (not shown). When the portion of the toolstring comprising the sub 10 approaches a deviated section of the wellbore, the downhole sub 10 will tend to drift towards one side of the internal diameter of the casing due to the deviation thereof. Depending upon the initial orientation of the downhole sub 10 within the casing as it approaches the internal diameter of the casing, one of the machined running edge 26, the head of the pin 36 and a portion of the roller 20 therebetween will contact the inner diameter of the casing. Similar contact will occur at each of the rollers 20 along the length of the downhole sub 10.

If the orientation of the downhole sub 10 is such that the machined running edge 26 makes initial contact with the inner diameter of the casing then the downhole sub 10 will tend to run along the edges 26 and thereby ensure minimal frictional resistance between the downhole sub 10 and the inner diameter of the casing.

In the event that the initial orientation of the downhole sub 10 is such that the first portion of the downhole sub 10 to contact the inner diameter of the casing is either the outer end of the pin 36 or a curved portion of the roller 20 between the outer end of the pin 36 and the machined running edge 26, the asymmetry of the rollers 20 projecting from the body 12 will tend to cause the sub 10 to rotate (this is possible due to the provision of swivels 16 at either end of the sub 10) until the machined running edge 26 of the roller 20 comes into contact with the bottom of the casing. Therefore regardless of the initial rotational orientation of the sub 10 is as it approaches the inner diameter of a deviated portion of the casing, the asymmetrical nature of the rollers 20 will ensure that the sub 10 and hence the toolstring is able to move through the casing with minimal frictional resistance.

A number of subs 10 may be incorporated along the length of the toolstring in order to allow each sub 10 to assume the correct orientation for that particular location in the deviated wellbore. This is possible due to the rotational dislocation between the orientation of the sub 10 and the rest of the toolstring (not shown).

It should be noted that in this embodiment the rollers 20 are able to freely rotate independent of one another due to the movement of the toolstring and hence the sub 10 in the casing. The rotation of rollers 20 is assisted by the ball bearing arrangement 28, 30. As each roller 20 attempts to rotate around the pin 36 the internal circumference of outer race 32 rotates ball bearing 30 which acts against the outer circumference of inner race 34. This action allows the roller 20 to rotate around the pin 36 with minimal frictional resistance.

Figure 2A:
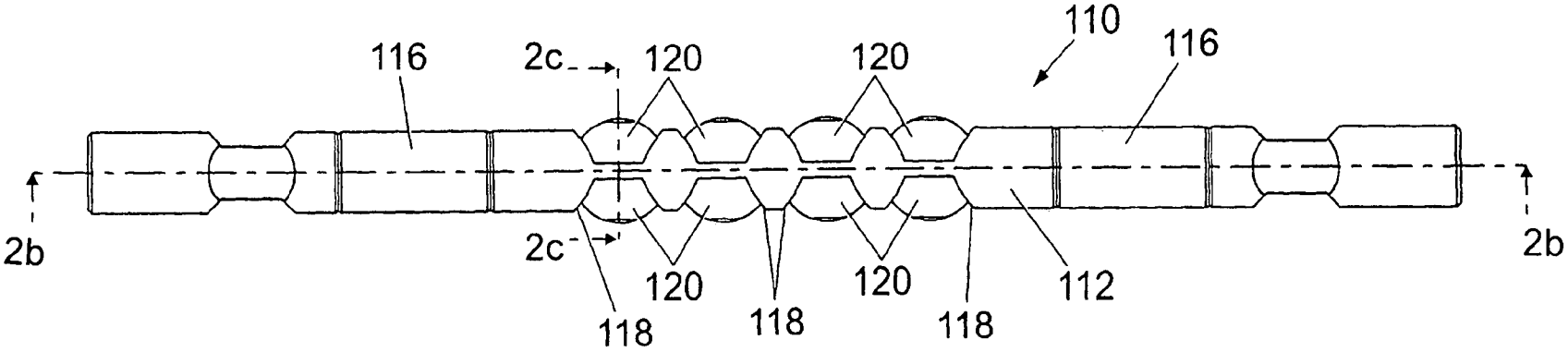
FIG. 2*a* is a planer view of a second embodiment of the device in accordance with the present invention.
Figure 2B:
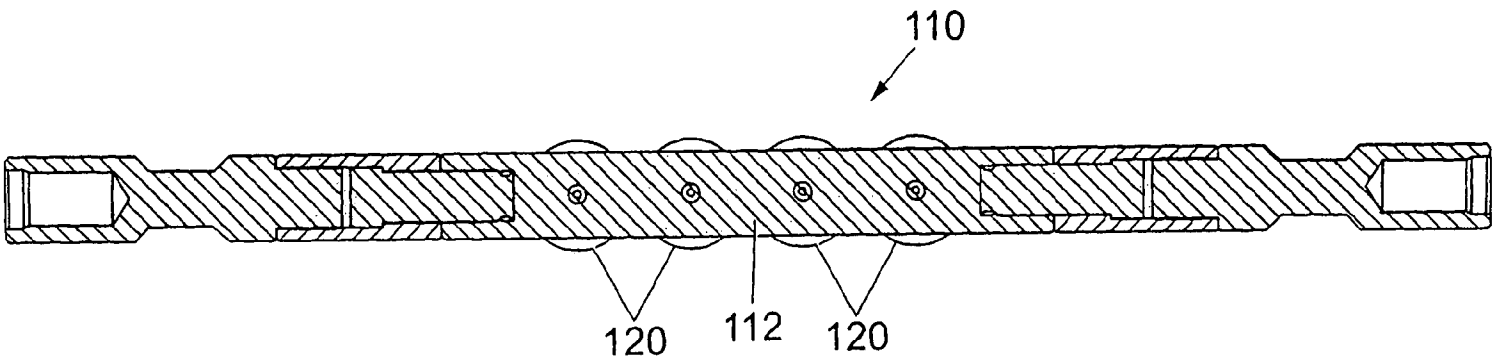
FIG. 2*b* is a transverse cross-sectional view of the device of FIG. 2*a* taken through the view 2*b*-2*b;*
Figure 2C:
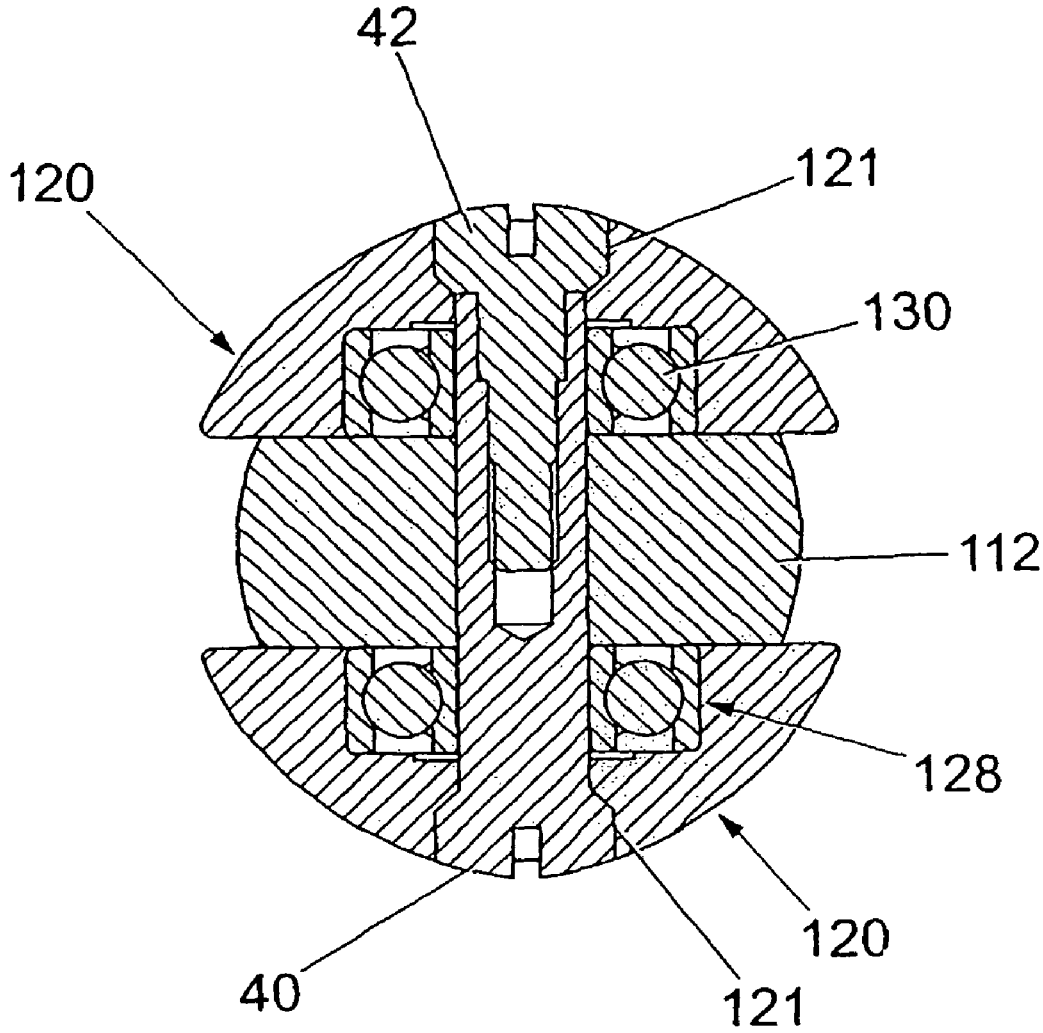
FIG. 2*c* is a cross-sectional view of a roller of the device of FIG. 2A taken through the view 2*c*-2*c;*

Referring to FIGS. 2*a*, 2*b* and 2*c* a second embodiment of a downhole sub will now be described. It should be noted that the second embodiment shares many common features with the first embodiment and where applicable these features have been referred to in the following description with similar numerals. A prefix 1 has been given to apparatus where this applies.

Figure 4:
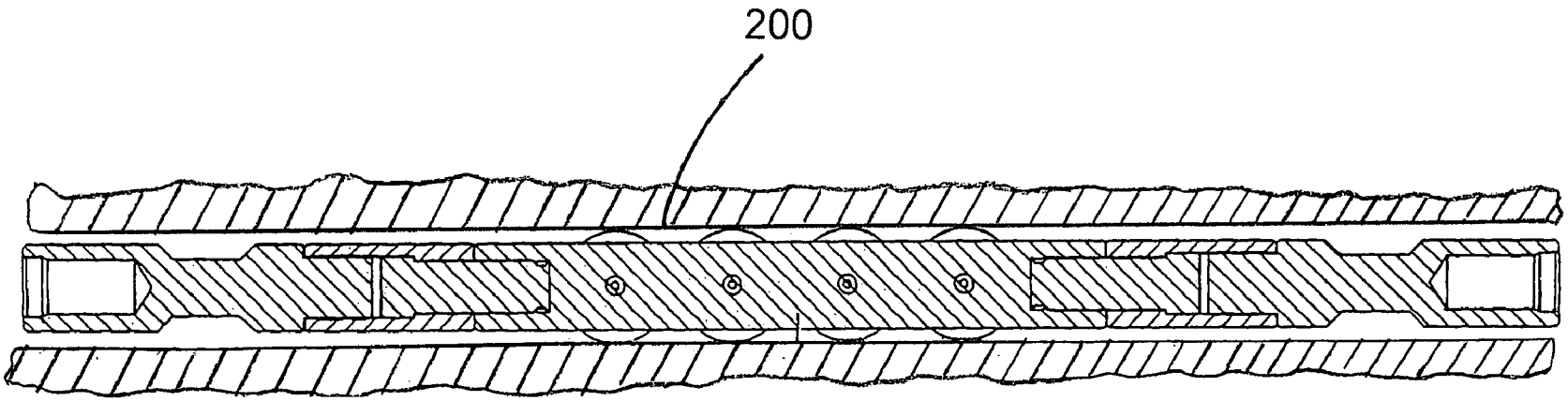
FIG. 4 illustrates the cross-sectional view of the device of FIG. 2*b* inside a casing.

The downhole sub 110 of FIG. 2 is provided with indents 118 on either side of the body 112 in order to accommodate rollers 120 on each side of the body 112. This embodiment provides greater support for the downhole sub 10 on rollers 120 and hence the toolstring to which it is attached (not shown) since fewer portions of the downhole sub 10 are unsupported by rollers 120. In addition the arrangement of rollers e.g. four on each side of the sub 110 results in the sub 110 having fewer points at which the body 112 of the sub 110 may contact the inner diameter 200 of the casing or other tubular in which the sub 110 is run. FIG. 4 illustrates the downhole sub inside a casing with the roller 120 contacting the inner diameter 200 of the casing.

Referring to FIG. 2*c*, each roller 120 is secured to the body 112 by a pair of interlocking pins 40, 42 which project through a throughbore 121 on each roller 120 and the centre of the body 112 in order to engage with one another and thereby secure the rollers 120 to the body 112 and also provide an axis of rotation about which the rollers 120 may rotate. The required asymmetry of the sub 110 may be provided by an asymmetrically shaped roller which has a greater diameter across one axis than an axis perpendicular to that axis i.e. an oval shaped roller or as shown in FIG. 2*c* a substantially uniformly dimensioned semi-spherical roller which has been offset from the body 12 longitudinal axis by a sufficient amount to provide the required difference in the cross-sectional shape of the body 112. In this regard it should be noted that the interengagement between pins 40 and 42 is arranged such that the overall dimension of the sub 110 is greater along the axis of rotation of the rollers 120 than the circumference of the rollers 120. Alternatively the asymmetry may simply be provided by a portion of the apparatus (such as pins 40, 42) extending from the body 112.

The various other components of the apparatus 110 of the second embodiment are substantially the same as those previously described in relation to the first embodiment and therefore will not be described any further.

In operation, the ball bearing arrangement provided by ball bearings 130 and ball bearing cage 128 of the sub 110 allows the rollers 120 to rotate about the interlocking pins 40, 42 whilst ensuring minimal frictional forces there between. In this embodiment the rollers 120 may move independently of one another which may be beneficial when e.g. discontinuities in the internal diameter of the casing are encountered i.e. one roller may rotate whilst the other does not.

Figure 3:
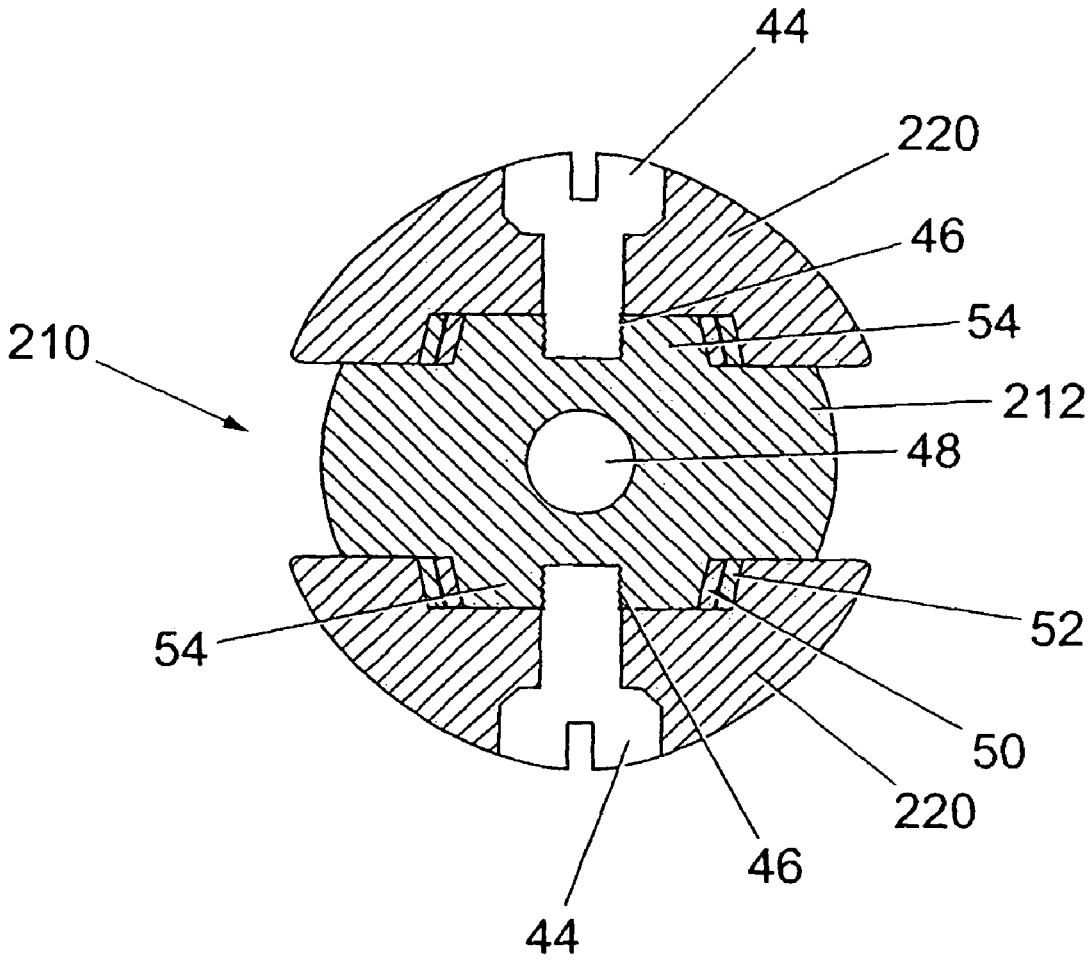
FIG. 3 is a cross-sectional view of a roller arrangement of a third embodiment of the device in accordance with the present invention.

Referring to FIG. 3 a third embodiment of a downhole sub will now be described. Again, it should be noted that the third embodiment shares many common features with the first embodiment and where applicable these features have been referred to in the following description with similar numerals. A prefix 2 has been given to apparatus where this applies.

Referring to FIG. 3 a further alternative embodiment of the downhole sub 210 is shown whereby the rollers 220 are secured to the body 212 by securing studs 44 on each side of the body 212. The securing studs 44 secure each roller 220 to the body by way of a threaded socket 46 in the body 212. In this way the centre of the downhole sub 210 is left free from obstructions and a central throughbore 48 can therefore be provided along the length of the downhole sub 210. The throughbore 48 may be used to house cables such as power or data cables (not shown) which are often necessary to provide a communication means along the length of the toolstring.

The embodiment shown in FIG. 3 may be used with a ball bearing cage similar to that described in relation to the first and second embodiments; however, due to the limited space available in the body 212 caused by providing throughbore 48 in the body 212 it is preferable to provide alternative means to assist the rotation of the rollers 220 around the pins 44 as shown in FIG. 3. Suitable alternative means comprise an inner slip surface 50 provided on a projecting shoulder 54 of the body 212 which abuts against an outer slip surface 52 provided on an inner cavity of each roller 220. The inner and outer slip surfaces 50, 52 are made of a suitable material such that the abutment between each slip surface 50, 52 is conducive to rotation of the rollers 220 around the projecting stud 54, i.e. the material on the surfaces 50, 52 is made of a suitable low frictional resistance material such as ceramic in order to cause minimal frictional resistance due to rotation of the rollers 220 relative to the body 212.

The various other components of the apparatus 210 of the third embodiment are substantially the same as those previously described in relation to the first embodiment and therefore will not be described any further.

In each embodiment previously described the distance (indicated by A in FIG. 1*c*) by which the rollers 20, 120 and 220 project from the respective body portions 12, 112 and 212 is manufactured such that the rollers may wear down during their operational lifetime without being worn down to such an extent that they are flush with the body 12, 112, 212 since this would cause the body portions to contact the inner diameter of the casing or other tubular.

Since the asymmetrical arrangement of the rollers in the embodiments described orientates the downhole sub in order that the running edge of the rollers engage the inner surface of the wellbore casing, this mitigates the possibility that the rollers fail to engage the inner surface of the wellbore casing by for instance the downhole sub resting on a portion not provided with rollers. This allows the sub to operate in highly deviated wells.

Modifications and improvements may be incorporated without departing from the scope of the invention, for example; further tools and/or subs such as inclination sensors, vibrators etc. may also be provided on the downhole subs previously described. In addition, drive motors may be provided to rotate the rollers when the deviation in the wellbore is large enough to prevent gravity alone progressing the downhole sub down the casing or other tubular.

The invention claimed is:

1. A downhole device for incorporation into a downhole string and movement in a well-bore, the device comprising:

a body member having a central longitudinal axis;

at least one roller arranged on the device to engage an inner surface of the well-bore, the at least one roller comprising a running edge extending around an outer circumference of the roller and a portion configured to orient the device in the wellbore, the roller having a rotational axis perpendicular to and extending through the central longitudinal axis of the body member and perpendicular to the circumferential running edge, the roller being mounted on the device so as to permit the roller to rotate about its rotational axis relative to the body member; and wherein the portion of the roller configured to orient the device comprises a projecting portion of the roller which projects radially outwardly from the body member in a direction of the rotation axis of the roller, the projecting portion of the roller is shaped such that the projecting portion of the roller is eccentric to the body member.

2. A downhole device according to claim 1, wherein a dimension of the roller along the axis of rotation of the roller is larger than a radial distance of the roller perpendicular to the axis of rotation.

3. A downhole device according to claim 1, wherein the eccentrically shaped portion comprises an oval shape which extends from an outer diameter of the roller to an end of the projecting portion.

4. A downhole device according to claim 1, wherein the portion of the roller configured to orient the device is provided by the roller being offset from the central longitudinal axis of the device such that the roller projects from the body of the device in the direction of the axis of rotation of the roller.

5. A downhole device according to claim 1, wherein the running edge is shaped such that it matches the inner surface of the well bore in which the device is to be run.

6. A downhole device according to claim 1, wherein the roller is secured to the device via a pin which provides the axis of rotation about which the roller may rotate.

7. A downhole device according to claim 1, wherein the roller is provided with a rotational friction reducing mechanism adapted to reduce frictional forces created when the roller rotates about the axis of rotation.

8. A downhole device according to claim 7, wherein the friction reducing mechanism comprises a roller bearing arrangement adapted to act between the portion of the roller and a portion of the pin.

9. A downhole device according to claim 7, wherein the friction reducing mechanism comprises a slip surface provided on the portion of the roller in abutment with a slip surface provided on a portion of the body member of the device.

10. A downhole device according to claim 9, wherein the friction reducing mechanism provides the axis of rotation about which the roller is rotatable.

11. A downhole device according to claim 10, wherein the slip surface comprises a durable low friction material.

12. A downhole device according to claim 9, wherein the slip surface comprises a durable low friction material.

13. A downhole device according to claim 1, wherein a plurality of rollers are provided on opposing sides of the device.

14. A downhole device according to claim 13, wherein the plurality of rollers are alternately spaced on opposing sides along the length of the device.

15. A downhole device according to claim 1, wherein the roller is provided in a recess provided in the body member of the device.

16. A downhole device according to claim 1, wherein the device has at least one swivel device arranged to allow rotation of the body member.

17. A downhole device according to claim 1, wherein a throughbore capable of housing at least one elongate member is provided within the body member of the device.

18. A downhole device for incorporation into a downhole string and movement in a well-bore, the device comprising:

a body member having a central longitudinal axis;

at least one roller arranged mounted to the body member and configured to engage an inner surface of the wellbore, the at least one roller comprising a running edge extending around an outer circumference of the roller and a portion configured to orient the device in the wellbore, the roller having a rotational axis perpendicular to and extending through the central longitudinal axis of the body member and perpendicular to the circumferential running edge, the roller being mounted on the device so as to permit the roller to rotate about its rotational axis relative to the body member, the roller mounted to the member such that the portion of the roller configured to orient the device is eccentric to the body member.

* * * * *